US010373547B2

(12) United States Patent
Sun et al.

(10) Patent No.: US 10,373,547 B2
(45) Date of Patent: Aug. 6, 2019

(54) DISPLAY SUBSTRATE AND DRIVING METHOD THEREOF, DISPLAY DEVICE

(71) Applicant: BOE TECHNOLOGY GROUP CO., LTD., Beijing (CN)

(72) Inventors: Tuo Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 196 days.

(21) Appl. No.: 15/325,053

(22) PCT Filed: Feb. 16, 2016

(86) PCT No.: PCT/CN2016/073873
§ 371 (c)(1),
(2) Date: Jan. 9, 2017

(87) PCT Pub. No.: WO2017/045352
PCT Pub. Date: Mar. 23, 2017

(65) Prior Publication Data

US 2017/0301278 A1 Oct. 19, 2017

(30) Foreign Application Priority Data

Sep. 18, 2015 (CN) ..... 2015 1 0599760

(51) Int. Cl.
*G09G 3/20* (2006.01)
*G09G 3/32* (2016.01)
(Continued)

(52) U.S. Cl.
CPC ..... *G09G 3/2092* (2013.01); *G09G 3/20* (2013.01); *G09G 3/32* (2013.01); *G09G 3/3233* (2013.01);
(Continued)

(58) Field of Classification Search
None
See application file for complete search history.

(56) References Cited

U.S. PATENT DOCUMENTS 5,151,689 A * 9/1992 Kabuto ..... G02F 1/1345 345/103
6,552,707 B1 4/2003 Fujiyoshi

FOREIGN PATENT DOCUMENTS

CN 101399000 A 4/2009
CN 101399000 A 4/2009
(Continued)

OTHER PUBLICATIONS

International Search Report with English Language Translation, dated Jun. 15, 2016, PCT Application No. PCT/CN2016/073873.
(Continued)

*Primary Examiner* — Ifedayo B Iluyomade
(74) *Attorney, Agent, or Firm* — Womble Bond Dickinson (US) LLP

(57) ABSTRACT

Embodiments of the disclosure provide a display substrate and a driving method thereof, as well as a display device. The display substrate comprises a plurality of select switch arrays and a plurality of selecting control circuits formed on the base substrate. Each select switch array comprises a plurality of select switches, a first terminal of each select switch being connected to a corresponding data line, a second end of each select switch being connected to a same data voltage input terminal, a control terminal of each select switch being connected to a same selecting control circuit. Each data line is connected with two columns of pixels, and the gate lines connected with the two columns of pixels are different. Each selecting control circuit is connected to a plurality of selecting control signal input terminals and a corresponding select switch array.

8 Claims, 4 Drawing Sheets

(51) Int. Cl.

| | |
|---|---|
| ***G09G 3/36*** | (2006.01) |
| ***G09G 3/3233*** | (2016.01) |
| ***G09G 3/3266*** | (2016.01) |
| ***G09G 3/3275*** | (2016.01) |

(52) U.S. Cl.
CPC ..... *G09G 3/36* (2013.01); *G09G 3/3648* (2013.01); *G09G 3/3266* (2013.01); *G09G 3/3275* (2013.01); *G09G 3/3618* (2013.01); *G09G 3/3677* (2013.01); *G09G 3/3688* (2013.01); *G09G 2300/0408* (2013.01); *G09G 2300/0814* (2013.01)

(56) References Cited

FOREIGN PATENT DOCUMENTS

| | | | |
|---|---|---|---|
| CN | 102856320 | A | 1/2013 |
| CN | 103514846 | A | 1/2014 |
| CN | 103514846 | A | 1/2014 |
| CN | 103943066 | A | 7/2014 |
| CN | 104575384 | A | 4/2015 |
| CN | 104575384 | A | 4/2015 |
| CN | 105096809 | A | 11/2015 |

OTHER PUBLICATIONS

Office Action in Chinese Application No. 201510599760.3 dated Apr. 21, 2017, with English translation.

* cited by examiner

| | Sequence of pixel data |
|---|---|
| Before rearrangement | P1-P2-P3-P4-P5-P6 |
| after rearrangement | P1-P3-P5-P2-P4-P6 |

DISPLAY SUBSTRATE AND DRIVING METHOD THEREOF, DISPLAY DEVICE

TECHNICAL FIELD

The disclosure relates to the field of display technology, particularly to a display substrate and a driving method thereof, as well as a display device.

BACKGROUND

In general display devices, each data line is connected with one column of pixels (the pixel here refers to the minimum unit for performing light emitting control, which corresponds to a minimum area defined by two adjacent data lines and two adjacent gate lines). The data lines are connected to a data voltage input terminal in the fan-out area. In large-scale display devices such as displays, mobile phones, PADs, the headspace of the display device is relatively large, which can provide a relatively large fan-out area, thereby accommodating enough data lines at this position. However, in design of some small special shaped display devices (such as smartwatches), it is required to reduce the headspace significantly. However, in order to accommodate the data lines, the fan-out area cannot be designed too small, which increases design difficulty of the display device.

SUMMARY

Therefore, it is desired to provide a display device that can have a relatively small headspace.

In a first aspect, an embodiment of the disclosure provides a display substrate, comprising a base substrate and a plurality of data lines, a plurality of gate lines and a plurality of pixels formed on the base substrate, and having a plurality of data voltage input terminals. The display substrate further comprises a plurality of select switch arrays and a plurality of selecting control circuits formed on the base substrate, and has a plurality of selecting control signal input terminals.

Each select switch array comprises a plurality of select switches. A first terminal of each select switch is connected to a corresponding data line. A second end of each select switch is connected to a same data voltage input terminal. A control terminal of each select switch is connected to a same selecting control circuit. Each data line connected with the select switch array is connected with two columns of pixels, and the gate line connected with pixels of one of the two columns differs from the gate line connected with pixels of the other column.

Each selecting control circuit is connected to a plurality of selecting control signal input terminals and a corresponding select switch array, and is adapted to turn on select switches in the connected select switch array in different times under control of selecting control signals inputted by the selecting control signal input terminals.

According to another embodiment, the selecting control signal input terminals comprise selecting signal input terminals and control signal input terminals.

Each selecting control circuit comprises a plurality of selecting control switch groups. Each selecting control switch group comprising two selecting control switches. First terminals of the two selecting control switches are connected to a control terminal of a same select switch. Second terminals of the two selecting control switches are connected to corresponding selecting signal input terminals respectively. Control terminals of the two selecting control switches are connected to corresponding control signal input terminals respectively. The selecting signal input terminals connected by selecting control switches in each selecting control circuit are different from each other, and the select switches connected by the selecting control switch groups are different from each other.

According to another embodiment, each selecting control circuit corresponds to two control signal input terminals. A control terminal of one selecting control switch in each selecting control switch group is connected with one of the two control signal input terminals, and a control terminal of the other selecting control switch is connected with the other of the two control signal input terminals.

According to another embodiment, the display substrate further comprises a pixel driving circuit and a data voltage write control line formed on the base substrate.

Each pixel comprises one pixel driving circuit. The pixel driving circuit is connected with a data line and a gate line corresponding to the pixel, and connected with the data voltage write control line. The pixel driving circuit is adapted to write a data voltage applied onto a data line connected by the pixel driving circuit into a first node under control of the data voltage write control line, write the data voltage into a second node under control of the gate line, and generate a current for driving the pixel based on a voltage of the second node.

According to another embodiment, one column of pixels and the other column of pixels in two columns of pixels connected to a same data line are in staggered arrangement.

In a second aspect, an embodiment of the disclosure further provides a method of driving the above display substrate, comprising:

when refreshing a plurality of pixels connected by each gate line, for a select switch array connected by the plurality of pixels, applying a selecting control signal on a selecting control signal input terminal connected with a selecting control circuit connected by the select switch array, so as to turn on the select switches in the select switch array in different times, and when each select switch is turned on, applying a data voltage corresponding to a pixel connected with a data line connected by the select switch on a data voltage input terminal connected by the select switch array; and applying a gate scanning signal on the gate line, so as to write the data voltage applied to the data voltage input terminal into a corresponding pixel.

According to another embodiment, the method further comprises: after receiving pixel data sent by a host, determining a sequence of pixels accessed to the data voltage input terminal according to preset gate line turn-on sequence and select switch turn-on sequence, and rearranging the received pixel data based on the determined sequence.

According to another embodiment, the method further comprises: when applying a data voltage corresponding to a pixel connected with a data line connected by the select switch on the data voltage input terminal connected by the select switch array, applying a control signal on a data voltage write control line connected by the pixel, so as to write the data voltage applied on the data voltage input terminal into a first node.

Applying a gate scanning signal on the gate line so as to write the data voltage applied on the data voltage input terminal into a corresponding pixel comprises:

after the select switches are turned on in different times, applying the gate scanning signal on the gate line, so as to write the data voltage written into the first node of each pixel into a second node of the pixel.

In a third aspect, an embodiment of the disclosure further provides a display driving system, comprising: a selecting driving circuit, a gate driving circuit and a data driving circuit. When refreshing a plurality of pixels connected by each gate line:

The selecting driving circuit is adapted to, for a select switch array connected by the plurality of pixels, apply a selecting control signal on a selecting control signal input terminal connected with the selecting control circuit connected by the select switch array, so as to turn on the select switches in the select switch array in different times.

The data driving circuit is adapted to, when each select switch is turned on, apply a data voltage corresponding to a pixel connected with a data line connected by the select switch on a data voltage input terminal connected by the select switch array.

The gate driving circuit is adapted to apply a gate scanning signal on the gate line, so as to write the data voltage applied on the data voltage input terminal into a corresponding pixel.

According to another embodiment, the data driving circuit comprises a rearrangement module. The rearrangement module is adapted to, after receiving pixel data sent by a host, determine a sequence of pixels accessed to the data voltage input terminal according to preset gate line turn-on sequence and select switch turn-on sequence, and rearrange the received pixel data based on the determined sequence.

According to another embodiment, the system further comprises a logic control circuit. The logic control circuit comprises a rearrangement module. The rearrangement module is adapted to, after receiving pixel data sent by a host, determine a sequence of pixels accessed to the data voltage input terminal according to preset gate line turn-on sequence and select switch turn-on sequence, rearrange the received pixel data based on the determined sequence, and inputting the rearranged data into the data driving circuit.

In a fourth aspect, an embodiment of the disclosure further provides a display device comprising the above display substrate.

In the display substrate provided by an embodiment of the disclosure, each data line is connected with two columns of pixels, and two columns of pixels connected to the same data line are connected with different gate lines. In this way, the number of the data lines used can be reduced greatly in the case of accomplishing the corresponding driving and displaying, which can reduce the area of the fan-out area required for accommodating the data lines, such that the corresponding display device can have a relatively small headspace. Therefore, design difficulty of the corresponding display device can be reduced. Meanwhile, in an embodiment of the disclosure, a plurality of data lines are connected to a same input terminal. That is, the same input terminal is used to drive a plurality of columns of pixels. Therefore, the number of the data driving circuits to be used can be reduced, so as to reduce the manufacture cost of the display device.

DETAILED DESCRIPTION OF THE INVENTION

Figure 1:
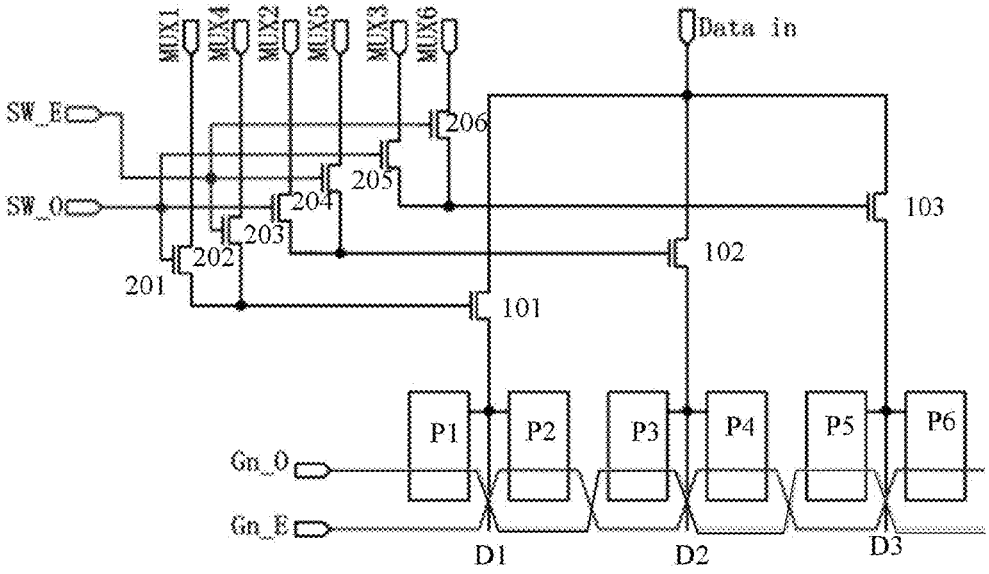
FIG. 1 is a structural schematic view of a display substrate provided by an embodiment of the disclosure.

Next, the specific implementations of the disclosure will be further described with reference to the drawings and the embodiments. The following embodiments are only used for explaining the technical solutions of the disclosure more clearly, rather than limiting the protection scope of the disclosure.

In a first aspect, an embodiment of the disclosure provides a display substrate, comprising a base substrate and a plurality of data lines, a plurality of gate lines and a plurality of pixels formed on the base substrate, and having a plurality of data voltage input terminals. The display substrate further comprises a plurality of select switch arrays and a plurality of selecting control circuits formed on the base substrate, and has a plurality of selecting control signal input terminals.

Each select switch array comprises a plurality of select switches. A first terminal of each select switch is connected to a corresponding data line. A second end of each select switch is connected to a same data voltage input terminal. A control terminal of each select switch is connected to a same selecting control circuit. Each data line connected with the select switch array is connected with two columns of pixels, and the gate line connected with pixels of one of the two columns differs from the gate line connected with pixels of the other column.

Each selecting control circuit is connected to a plurality of selecting control signal input terminals and a corresponding select switch array, and is adapted to turn on select switches in the connected select switch array in different times under control of selecting control signals inputted by the selecting control signal input terminals.

In the display substrate provided by an embodiment of the disclosure, each data line is connected with two columns of pixels, and two columns of pixels connected to the same data line are connected with different gate lines. In this way, the number of the data lines used can be reduced greatly in the case of accomplishing the corresponding driving and displaying, which can reduce the area of the fan-out area required for accommodating the data lines, such that the corresponding display device can have a relatively small headspace. Therefore, design difficulty of the corresponding display device can be reduced. Meanwhile, in an embodiment of the disclosure, a plurality of data lines are connected to a same data voltage input terminal. That is, the same input terminal is used to drive a plurality of columns of pixels. Therefore, the number of the data driving circuits to be used can be reduced, so as to reduce the manufacture cost of the display device.

In a second aspect, an embodiment of the disclosure further provides a method of driving a display substrate, which can be used for driving the display substrate according to the first aspect. The method comprises:

when refreshing a plurality of pixels connected by each gate line, for a select switch array connected by the plurality of pixels, applying a selecting control signal on a selecting control signal input terminal connected with a selecting control circuit connected by the select switch array, so as to turn on the select switches in the select switch array in different times, and when each select switch is turned on, applying a data voltage corresponding to a pixel connected with a data line connected by the select switch on a data voltage input terminal connected by the select switch array; and applying a gate scanning signal on the gate line, so as to write the data voltage applied to the data voltage input terminal into a corresponding pixel.

In a third aspect, an embodiment of the disclosure further provides a display driving system, comprising: a selecting driving circuit, a gate driving circuit and a data driving circuit. When refreshing a plurality of pixels connected by each gate line:

The selecting driving circuit is adapted to, for a select switch array connected by the plurality of pixels, apply a selecting control signal on a selecting control signal input terminal connected with the selecting control circuit connected by the select switch array, so as to turn on the select switches in the select switch array in different times.

The data driving circuit is adapted to, when each select switch is turned on, apply a data voltage corresponding to a pixel connected with a data line connected by the select switch on a data voltage input terminal connected by the select switch array.

The gate driving circuit is adapted to apply a gate scanning signal on the gate line, so as to write the data voltage applied on the data voltage input terminal into a corresponding pixel.

In specific implementations, the above display substrate may have various specific structures, and the corresponding driving methods and manufacturing methods may also be different from each other, which will be explained in detail with reference to the drawings next.

In addition, in specific implementations, the display substrate provided by an embodiment of the disclosure can comprise a plurality of select switch arrays and a plurality of selecting control circuits. Each select switch array is connected with one data voltage input terminal and one selecting control circuit. Next, explanations will be made in the case that one select switch array is connected to a data voltage input terminal and a selecting control circuit corresponding to it.

Referring to FIG. 1, FIG. 1 is a structural schematic view of a partial area of a display substrate provided by an embodiment of the disclosure. The display substrate comprises: a base substrate (not shown in the figure), a plurality of data lines D1-D3 and two gate lines Gn_O and Gn_E (n is any positive integer smaller than M, M is the row number of the display substrate) formed on the base substrate, as well as a plurality of pixels P1-P6 located in the nth row. The display substrate further has data voltage input terminals Data in. Each data line is connected with two columns of pixels, while in each row, the gate lines connected by two pixels connected to the same data line are different. For example, the data line D1 is connected with two columns of pixels P1 and P2, and the pixel P1 is connected to the gate line Gn_O, while the pixel P2 is connected to the gate line Gn_E.

In addition, the display substrate further comprises select switch arrays and selecting control circuits formed on the base substrate. The select switch array comprises three select switches 101-103. The selecting control circuit comprises six selecting control switches 201-206. The display substrate further has a plurality of selecting control signal input terminals. The selecting control signal input terminals can comprise selecting signal input terminals MUX1, MUX2 . . . MUX6 and control signal input terminals SW_E and SW_O. Each of the three select switches corresponds to one data line, and a first terminal of each select switch is connected to a corresponding data line, a second terminal of each select switch is connected to a data voltage input terminal Data in. For instance, the first terminal of the select switch 101 is connected to the corresponding data line D1, and its second terminal is connected to the data voltage input terminal Data in. The six selecting control switches are divided into three selecting control switch groups. Each selecting control switch group corresponds to one select switch. Each selecting control switch group includes two selecting control switches. First terminals of two selecting control switches that belong to the same selecting control switch group are both connected to a control terminal of a select switch corresponding to them. Second terminals of two selecting control switches that belong to the same selecting control switch group are connected to corresponding selecting signal input terminals respectively. Control terminals of two selecting control switches that belong to the same selecting control switch group are connected to corresponding control signal input terminals respectively. For instance, the first terminals of the two selecting control switches 201 and 202 that belong to the same selecting control switch group are both connected to the control terminal of the select switch 101 corresponding to them. The second terminal of the selecting control switch 201 is connected to the selecting signal input terminal MUX1, and its control terminal is connected to the control signal input terminal SW_O; while the second terminal of the selecting control switch 202 is connected to the selecting signal input terminal MUX4, and its control terminal is connected to the control signal input terminal SW_E.

Figure 2:
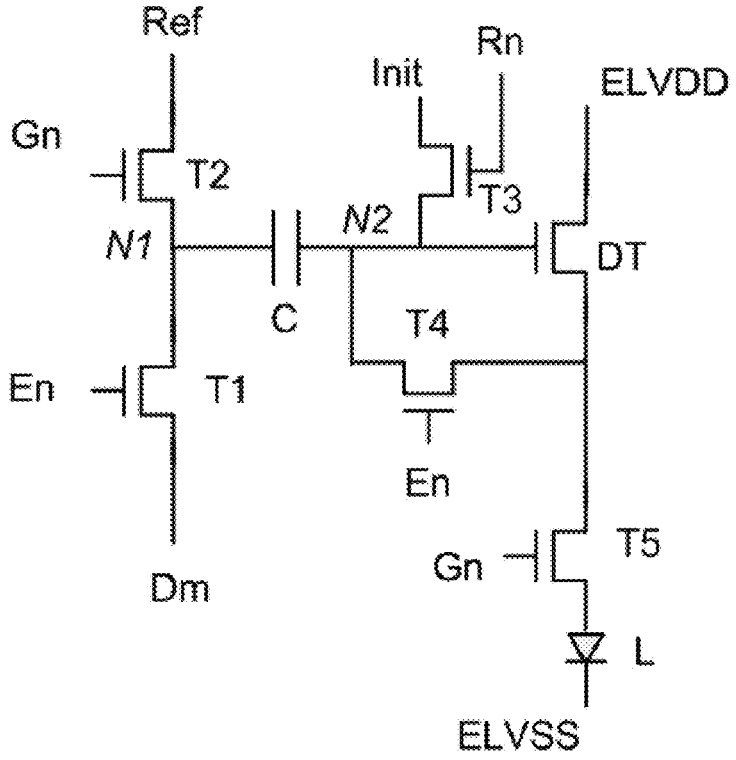
FIG. 2 is a structural schematic view of a pixel driving circuit.

In specific implementation, the display substrate in FIG. 1 for example can be an AMOLED display substrate, and can also be a liquid crystal display substrate. When the above display substrate is an AMOLED display substrate, it may further comprise: a pixel driving circuit and a data voltage write control line formed on the base substrate. Each pixel driving circuit is connected with one pixel and a data line and a gate line connected by the pixel, and connected with the data voltage write control line. The pixel driving circuit is adapted to write a data voltage applied onto a data line connected by the pixel driving circuit into a first node under control of the data voltage write control line, write the data voltage into a second node under control of the gate line, and generate a current for driving the pixel based on a voltage of the second node. In specific implementation, such a pixel driving circuit may have various specific structures. For instance, what is shown in FIG. 2 is a pixel driving circuit. The pixel driving circuit has a first node N1 and a second node N2. The first node N1 and the second node N2 are both connected to a capacitor C, and connected to different plates of the capacitor C. The second node N2 is further connected to a gate of a driving transistor DT. In this pixel driving circuit, a gate of a first switch transistor T1 is connected with a data voltage write control line En, a source thereof is connected with a data line Dm, and a drain thereof is connected with the first node N1. The first transistor can be turned on by applying a corresponding control signal on the data voltage write control line En, so as to write the data voltage applied on the data line Dm into the first node N1. Subsequently, a gate scan driving signal is applied to a gate line Gn connected with a gate of a switch transistor T2 connected by the first node N1 by enabling the second node N2 to be floated, so as to turn on the switch transistor T2, and another voltage is applied on a source Ref of the switch transistor T2 to enable voltage jump of the second node N2.

In this way, the data voltage written into the first node N1 will be written into the second node N2. The detailed operation of the pixel driving circuit as shown in FIG. 2 will not be explained specifically herein.

Such a display substrate can be driven in the following way.

Figures 3, 4:
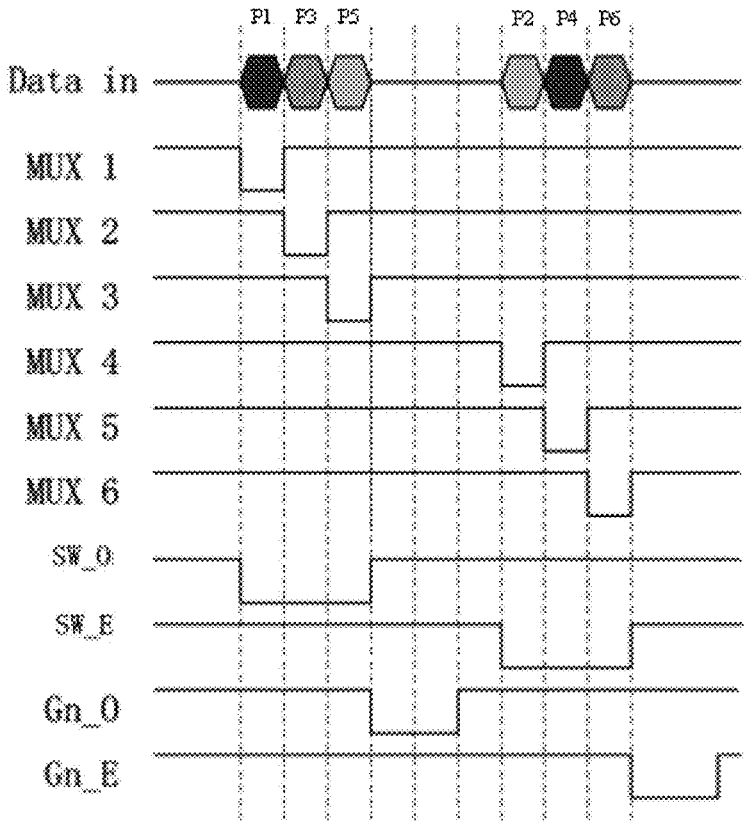
FIG. 3 is a timing diagram of signals when driving the pixel circuit in FIG. 1.
FIG. 4 is a sequence relationship diagram of pixel data before and after rearrangement.

When it is required to refresh the nth row of pixels P1-P6 in FIG. 1, the pixels connected by the gate line Gn_O can be refreshed firstly in the manner as shown in FIG. 3. Then the pixels connected by the gate line Gn_E are refreshed. Specifically, when the pixels connected by the gate line Gn_O are refreshed, selecting signals (in FIG. 3 the selecting signals are assumed to be of low level) can be applied on the selecting signal input terminals connected by the selecting control switches 201, 203, 205 successively, so as to turn on the select switches 101, 102 and 103 successively. And when the select switch 101 is turned on, a data voltage corresponding to the pixel P1 is applied on the data line D1. When the select switch 102 is turned on, a data voltage corresponding to the pixel P3 is applied on the data line D2. When the select switch 103 is turned on, a data voltage corresponding to the pixel P5 is applied on the data line D3. A control signal is applied on the data voltage write control line connected by each pixel, thereby writing the data voltage applied on the data voltage input terminal into the first node within this pixel. Subsequently, a gate scanning signal is applied on the gate line Gn_O, so as to write the data voltages that have been written into the first nodes of the pixels P1, P3 and P5 into the second nodes of the pixels correspondingly. The second node is connected with the gate of the driving transistor in the data driving circuit. The process of refreshing the pixels connected by the gate line Gn_E can also refer to FIG. 3, which is consistent with the process of refreshing the pixels connected by the gate line Gn_O, and will not be explained specifically here.

From the above driving process it can be seen that, in specific implementation, the sequence of writing the data voltages of the pixels into the pixels is P1-P3-P5-P2-P4-P6. In general, however, the sequence of pixel data sending to the data driving circuit by a host is P1-P2-P3-P4-P5-P6. Hence, in order to write the correct data voltages into the pixels, the above pixel data can be rearranged. Specifically, the rearranging process here can be performed by the data driving circuit. The data driving circuit can comprise a rearrangement module for rearranging the pixel data. The rearrangement module is adapted to, after receiving pixel data sent by a host, determine a sequence of pixels accessed to the data voltage input terminal according to preset gate line turn-on sequence and select switch turn-on sequence, and rearrange the received pixel data based on the determined sequence. Referring to FIG. 4, which is a schematic view of the arrangement sequence of pixel data corresponding to the pixels before and after the rearrangement. Before the rearrangement, the arrangement sequence of the pixel data corresponding to the pixels is P1-P2-P3-P4-P5-P6, while after the rearrangement, the arrangement sequence of the pixel data corresponding to the pixels is P1-P3-P5-P2-P4-P6.

Figure 5:
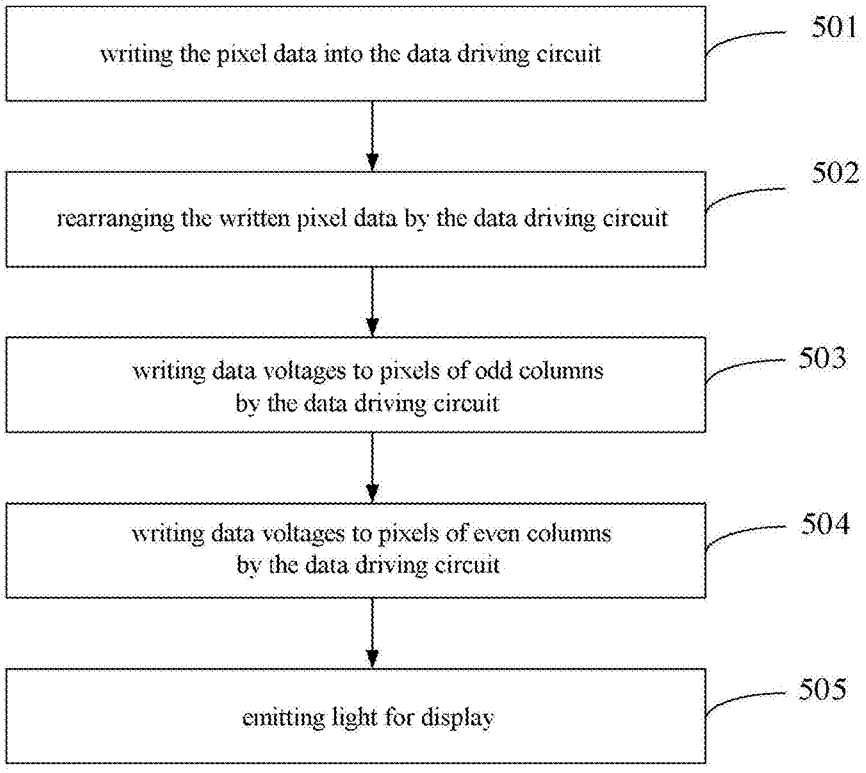
FIG. 5 is a flow chart of a display driving method when the data driving circuit comprises a rearrangement module.

Here, the process of the above driving method is as shown in FIG. 5, comprising:

step 501, writing the pixel data into the data driving circuit;

step 502, rearranging the written pixel data by the data driving circuit;

step 503, writing data voltages to pixels of odd columns by the data driving circuit;

step 504, writing data voltages to pixels of even columns by the data driving circuit;

step 505, emitting light for display.

The processes of steps 503 and 504 can be consistent with the driving method as shown in FIG. 3, which will not be explained specifically here.

Alternatively, in specific implementations, the rearrangement module can also be arranged in other circuits, for example, it can be arranged in a logic control circuit (the logic control circuit for example can be FPGA).

The rearrangement module is adapted to, after receiving pixel data sent by a host, determine a sequence of pixels accessed to the data voltage input terminal according to preset gate line turn-on sequence and select switch turn-on sequence, rearrange the received pixel data based on the determined sequence, and input the rearranged data into the data driving circuit. When the pixel data are rearranged using the rearrangement module, the rearrangement result is as shown in FIG. 4, which will not be explained specifically here.

Figure 6:
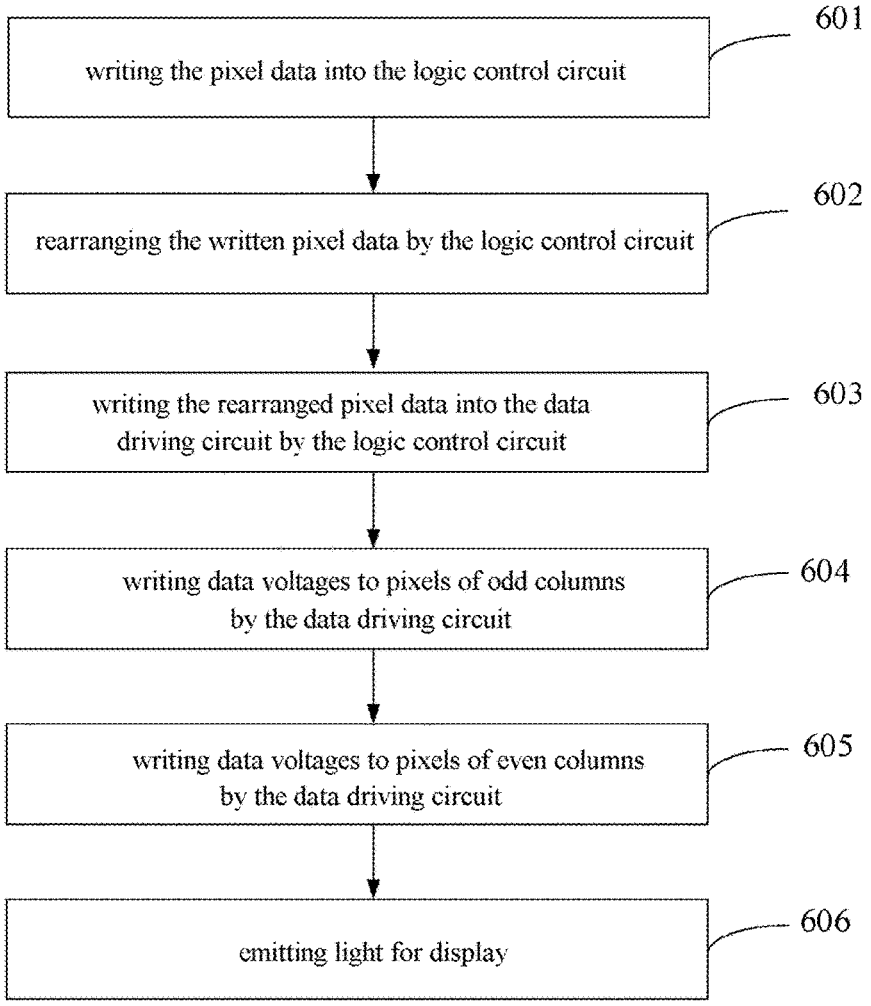
FIG. 6 is a flow chart of a display driving method when the logic control circuit comprises a rearrangement module.

Here, the process of the above driving method is as shown in FIG. 6, comprising:

step 601, writing the pixel data into the logic control circuit;

step 602, rearranging the written pixel data by the logic control circuit;

step 603, writing the rearranged pixel data into the data driving circuit by the logic control circuit;

step 604, writing data voltages to pixels of odd columns by the data driving circuit;

step 605, writing data voltages to pixels of even columns by the data driving circuit;

step 605, emitting light for display.

Certainly, in actual applications, the above rearranging process can also be performed by the host or other functional modules. The corresponding technical solutions can also implement correct writing of the data voltage. Hence, the corresponding technical solutions should also fall within the protection scope of the disclosure.

It is not difficult to understand that although it is explained in embodiments of the disclosure by taking the display substrate as an AMOLED display substrate, in specific implementation, the display substrate can also be a liquid crystal display substrate. If the display substrate is a liquid crystal display substrate, a gate scanning signal can be applied on the gate line connected by pixels of odd columns while the data driving circuit writes data voltages into the pixels of odd columns. And a gate scanning signal can be applied on the gate line connected by pixels of even columns while the data driving circuit writes data voltages into the pixels of even columns.

Figure 7:
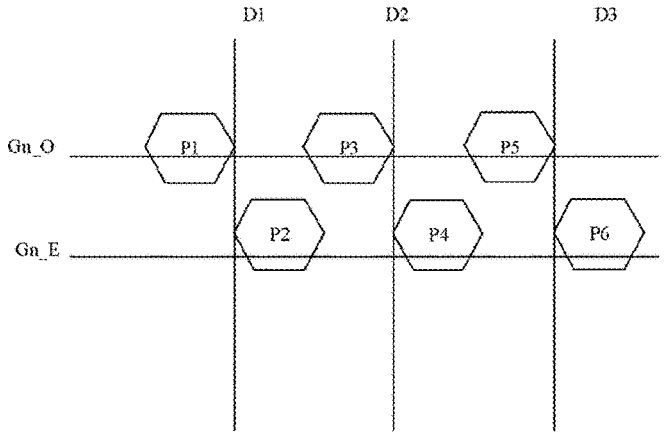
FIG. 7 is a structural schematic view of a display substrate provided by another embodiment of the disclosure.

Another embodiment of the disclosure further provides another display substrate. The structure of the display substrate is as shown in FIG. 7. Different from FIG. 1, a first column of pixels and a second column of pixels in two columns of pixels connected by each data line are in staggered arrangement in the row direction. For instance, the two pixels P1 and P2 connected to the same data line D1 are in staggered arrangement in the row direction, rather than being aligned. Other structures and driving methods of the display substrate provided by Embodiment Two can be similar as those of Embodiment One, which will not be explained specifically here.

In Embodiment Two, since the pixels are in staggered arrangement, the pixel driving circuits arranged in the pixels can be arranged in two rows, and the gate lines can also be arranged in two rows. In this way, mutual interference between the gate lines can be avoided.

In a fourth aspect, an embodiment of the disclosure provides a display device, comprising the above display substrate.

What are stated above are only specific implementations of the disclosure. It should be pointed out that the ordinary skilled person in the art can also make various improvements and modifications without departing from the technical principle of the disclosure. These improvements and modifications should also be regarded as being encompassed within the protection scope of the disclosure.

The invention claimed is:

1. A display substrate, comprising a base substrate and a plurality of data lines, a plurality of gate lines and a plurality of pixels formed on the base substrate, and having a plurality of data voltage input terminals, wherein the display substrate further comprises a plurality of select switch arrays and a plurality of selecting control circuits formed on the base substrate, and has a plurality of selecting control signal input terminals, wherein each select switch array comprises a plurality of select switches, a first terminal of each select switch being connected to a corresponding data line, a second end of each select switch being connected to a same data voltage input terminal, a control terminal of each select switch being connected to a same selecting control circuit, wherein each data line connected with the select switch array is connected with two columns of pixels, and the gate line connected with pixels of one of the two columns differs from the gate line connected with pixels of the other column, and wherein each selecting control circuit is connected to a plurality of selecting control signal input terminals and a corresponding select switch array, and is adapted to turn on select switches in the connected select switch array in different times under control of selecting control signals inputted by the selecting control signal input terminals, wherein the selecting control signal input terminals comprise selecting signal input terminals and control signal input terminals, wherein each selecting control circuit comprises a plurality of selecting control switch groups, each selecting control switch group comprising two selecting control switches, first terminals of the two selecting control switches being connected to a control terminal of a same select switch, second terminals of the two selecting control switches being connected to corresponding selecting signal input terminals respectively, control terminals of the two selecting control switches being connected to corresponding control signal input terminals respectively, wherein the selecting signal input terminals connected by selecting control switches in each selecting control circuit are different from each other, and the select switches connected by the selecting control switch groups are different from each other, wherein the display substrate further comprises a pixel driving circuit and a data voltage write control line formed on the base substrate, and wherein each pixel comprises one pixel driving circuit, the pixel driving circuit being connected with a data line and a gate line corresponding to the pixel, and connected with the data voltage write control line, and wherein the pixel driving circuit is adapted to write a data voltage applied onto a data line connected by the pixel driving circuit into a first node under control of the data voltage write control line, write the data voltage into a second node under control of the gate line, and generate a current for driving the pixel based on a voltage of the second node.

2. The display substrate as claimed in claim 1, wherein each selecting control circuit corresponds to two control signal input terminals, a control terminal of one selecting control switch in each selecting control switch group being connected with one of the two control signal input terminals, and a control terminal of the other selecting control switch being connected with the other of the two control signal input terminals.

3. The display substrate as claimed in claim 1, wherein one column of pixels and the other column of pixels in two columns of pixels connected to a same data line are in staggered arrangement.

4. A method of driving a display substrate as claimed in claim 1, comprising:

when refreshing a plurality of pixels connected by each gate line, for a select switch array connected by the plurality of pixels, applying a selecting control signal on a selecting control signal input terminal connected with a selecting control circuit connected by the select switch array, so as to turn on the select switches in the select switch array in different times, and when each select switch is turned on, applying a data voltage corresponding to a pixel connected with a data line connected by the select switch on a data voltage input terminal connected by the select switch array; and applying a gate scanning signal on the gate line, so as to write the data voltage applied to the data voltage input terminal into a corresponding pixel wherein the method further comprises: after receiving pixel data sent by a host, determining a sequence of pixels accessed to the data voltage input terminal according to preset gate line turn-on sequence and select switch turn-on sequence, and rearranging the received pixel data based on the determined sequence.

5. The method as claimed in claim 4, further comprising: when applying a data voltage corresponding to a pixel connected with a data line connected by the select switch on the data voltage input terminal connected by the select switch array, applying a control signal on a data voltage write control line connected by the pixel, so as to write the data voltage applied on the data voltage input terminal into a first node;

wherein applying a gate scanning signal on the gate line so as to write the data voltage applied on the data voltage input terminal into a corresponding pixel comprises:

after the select switches are turned on in different times, applying the gate scanning signal on the gate line, so as to write the data voltage written into the first node of each pixel into a second node of the pixel.

6. A display driving system, comprising: a selecting driving circuit, a gate driving circuit and a data driving circuit, wherein when refreshing a plurality of pixels connected by each gate line, the selecting driving circuit is adapted to, for a select switch array connected by the plurality of pixels, apply a selecting control signal on a selecting control signal input terminal connected with the selecting control circuit connected by the select switch array, so as to turn on the select switches in the select switch array in different times, wherein the data driving circuit is adapted to, when each select switch is turned on, apply a data voltage corresponding to a pixel connected with a data line connected by the select switch on a data voltage input terminal connected by the select switch array, and wherein the gate driving circuit is adapted to apply a gate scanning signal on the gate line, so as to write the data voltage applied on the data voltage input terminal into a corresponding pixel, and wherein the data driving circuit comprises a rearrangement module, and wherein the rearrangement module is adapted to, after receiving pixel data sent by a host, determine a sequence of pixels accessed to the data voltage input terminal according to preset gate line turn-on sequence and select switch turn-on sequence, and rearrange the received pixel data based on the determined sequence.

7. The system as claimed in claim 6, further comprising a logic control circuit, wherein the logic control circuit comprises a rearrangement module, and wherein the rearrangement module is adapted to, after receiving pixel data sent by a host, determine a sequence of pixels accessed to the data voltage input terminal according to preset gate line turn-on sequence and select switch turn-on sequence, rearrange the received pixel data based on the determined sequence, and inputting the rearranged data into the data driving circuit.

8. A display device, comprising a display substrate as claimed in claim 1.

* * * * *